United States Patent [19]

Potier

[11] Patent Number: 4,665,972

[45] Date of Patent: May 19, 1987

[54] OIL-RADIATOR-CONTAINING WATER BOX FOR A MOTOR VEHICLE HEAT EXCHANGER

[75] Inventor: Michel Potier, Rambouillet, France

[73] Assignee: Valeo, Paris, France

[21] Appl. No.: 841,932

[22] Filed: Mar. 20, 1986

[30] Foreign Application Priority Data

Mar. 21, 1985 [FR] France ..... 85 04214

[51] Int. Cl.[4] ..... F28F 7/00; F28D 7/10

[52] U.S. Cl. ..... 165/76; 165/140; 165/916

[58] Field of Search ..... 165/140, 154, 76, DIG. 916; 123/41.33

[56] References Cited

U.S. PATENT DOCUMENTS

| | | | |
|---|---|---|---|
| 3,364,160 | 5/1963 | Beurthert . | |
| 4,094,358 | 6/1978 | Neveux | 165/154 |
| 4,227,570 | 10/1980 | Crews . | |

FOREIGN PATENT DOCUMENTS

| | | |
|---|---|---|
| 097431 | 4/1984 | European Pat. Off. . |
| 2004860 | 8/1970 | Fed. Rep. of Germany . |
| 3236620 | 4/1983 | Fed. Rep. of Germany . |
| 2306421 | 10/1976 | France . |
| 2389306 | 11/1978 | France . |
| 2515259 | 4/1983 | France . |
| 2521277 | 8/1983 | France . |
| 2549593 | 1/1985 | France . |

*Primary Examiner*—Albert W. Davis, Jr.
*Assistant Examiner*—Richard R. Cole
*Attorney, Agent, or Firm*—Dennison, Meserole, Pollack & Scheiner

[57] ABSTRACT

An oil radiator (16) containing heat exchanger water box has oil inlet/outlet tubes (22) passing through openings in the wall of the water box, which openings are of greater diameter than the diameter of said oil inlet/outlet tubes or of their flanges (26) in order to enable the oil radiator to be placed inside a water box (34) of normal width (L'). The invention is applicable to motor vehicle heat exchangers.

7 Claims, 4 Drawing Figures

OIL-RADIATOR-CONTAINING WATER BOX FOR A MOTOR VEHICLE HEAT EXCHANGER

The invention relates to a water box for a motor vehicle heat exchanger, said water box containing an oil radiator for cooling the oil which flows through the radiator by means of the liquid which flows through the heat exchanger.

BACKGROUND OF THE INVENTION

In prior devices of this type, the oil radiator is placed in the water box prior to the water box being mounted on the end of a bundle of tubes or of a heat exchanger body, with the oil radiator being inserted inside the water box via the open face of the water box which is then placed over the end of the body or the bundle of tubes of the heat exchanger. The oil radiator includes two connection tubes for connecting to the lubricating oil circuit of an engine and/or a gear box, and these tubes are mounted in sealed manner through corresponding orifices in the side wall of the water box, which orifices are of substantially the same diameters as the outside diameters of the corresponding tubes, for ease of sealing.

In order for the radiator to be mountable in the water box, the water box must have a width which is at least substantially equal to the overall outside dimensions of the oil radiator in the same direction, i.e. in general to the width of the radiator plus the length of its inlet and outlet tubes. The water box must thus be relatively wide, and in any case much wider than the thickness or corresponding dimension of current heat exchanger bundles of tubes, thereby giving rise to a water box which is oversize relative to the size of the bundle.

Proposals have already been made, for example as described in French patent specification published under No. 2 549 593, to tilt the radiator for insertion into the water box via its open face, so that the inlet and outlet tubes of the radiator can be inserted at an angle through the orifices of the side wall of the water box. However, in order to do this the water box still needs to be wider than a conventional water box, thereby requiring the use of water boxes, perforated plates, and sealing gaskets which are special instead of conventional water boxes, perforated plates, and gaskets, whenever an oil radiator is to be disposed inside a water box.

Preferred embodiments of the present invention seek to mitigate these drawbacks.

SUMMARY OF THE INVENTION

The present invention provides a water box for a motor vehicle heat exchanger, said box including an oil radiator having an oil inlet tube and an oil outlet tube which pass in sealed manner through two corresponding openings through the side wall of the water box, and which serve to hold and fix the oil radiator inside the water box, said water box including the improvement whereby said openings are considerably larger than the outside diameter of said oil inlet and outlet tubes, with said openings being closed by two add-on plates each of which includes an orifice for passing an oil inlet/outlet tube, and each of which is fixed to the edge of the corresponding opening through the water box.

A heat exchanger water box is thus provided which has the same overall size as a conventional water box while nevertheless being capable of containing an oil radiator of the same size as has previously required the use of an oversize water box.

This water box structure can be used in conjunction with the same perforated plates and the same gaskets as are used with a conventional water box that does not contain an oil radiator, and at the same time it makes it possible to use oil radiators which previously required the use of special, oversize water boxes.

Each of the openings through the side wall of the water box is of such a size as to allow an oil inlet or outlet tube to the oil radiator to pass freely therethrough while the oil radiator is being inserted into the water box via the open face thereof.

In addition, each oil radiator inlet or outlet tube includes an annular flange which is pressed against the inside face of said plate, together with a portion which has an outside thread, which passes through to the other side of the plate and which receives a nut for pressing said plate against said annular flange.

BRIEF DESCRIPTION OF THE DRAWINGS

An embodiment of the invention is described by way of example with reference to the accompanying drawings, in which.

MORE DETAILED DESCRIPTION

Figure 1:
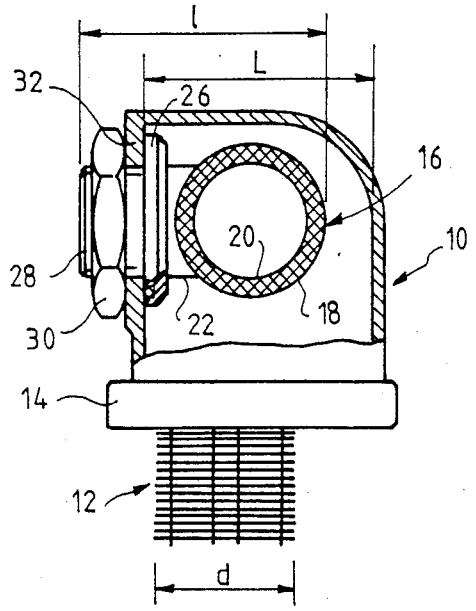
FIG. 1 PRIOR ART
FIG. 1 is a diagrammatic cross-section through the top portion of a heat exchanger, showing a prior art water box containing an oil radiator.

Reference is made initially to FIG. 1 which shows a prior art water box containing an oil radiator.

The prior art water box 10 is conventionally mounted at one end of a bundle of tubes 12 by means of a perforated plate 14, and contains conventional oil radiator 16 of the tubular type.

Figure 3:
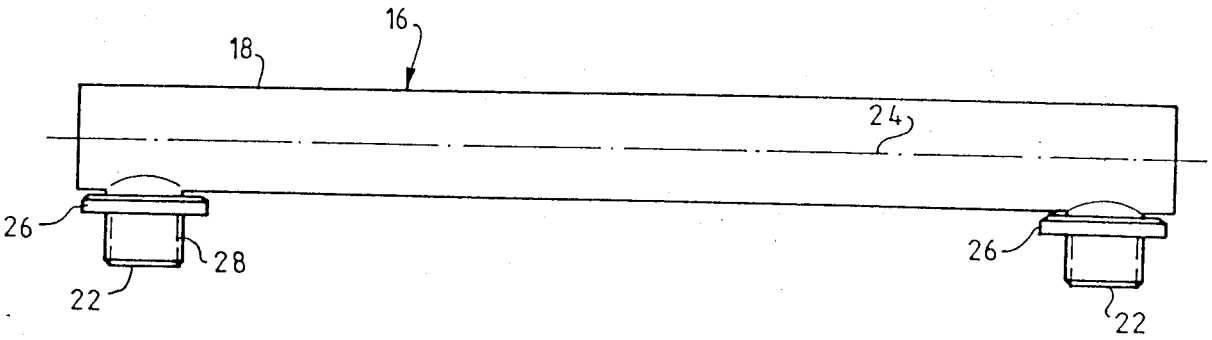
FIG. 3 is an elevation view of the oil radiator.

The oil radiator 16 (also shown in FIG. 3) comprises two coaxial cylindrical walls 18 and 20 of circular section, which are interconnected in sealed manner at their ends, together with two inlet/outlet tubes 22 disposed in the vicinity of said axial ends and opening out into the annular space lying between the cylindrical walls 18 and 20. Each of the tubes 22 is oriented perpendicularly to the axis 24 of the oil radiator 16 and includes an annular flange 26 in the immediate vicinity of the outer cylindrical wall 18 of the oil radiator, together with an end cylindrical portion having an outside thread 28 for receiving a nut 30.

The water box 10 includes a side wall 32 having two orifices through which the cylindrical end portions 28 of the oil radiator inlet/outlet tubes 22 are passed. The flanges 26 and the tubes 22 are pressed against a sealing gasket placed against the inside face of the water box side wall 32, and the nuts 30 are screwed onto the ends 28 of the tubes so as to press against the outside face of the side wall 32, thereby holding and fixing the oil radiator 16 to the side wall 32 of the water box 10.

During assembly and prior to the water box 10 being fixed to the perforated plate 14, the oil radiator 16 is inserted into the water box through its open face which is subsequently placed over the end of the bundle of tubes 12, and the water box includes a peripheral rim (not shown in FIG. 1) via which it is fixed to the perforated plate 14.

In order for this assembly to be possible, the inside width L of the water box 10 must be substantially equal to the overall width 1 of the radiator 16, i.e. to the sum of the outside diameter of the outer cylindrical wall 18 plus the length of the tubes 22. The width L of the water box 10 is thus considerably greater than the corresponding width d of the bundle of tubes 12 and is oversize relative thereto. The perforated plate 14 and the sealing gaskets which co-operate therewith and with the peripheral rim of the open face of the water box 10 are necessarily of a width which corresponds to the water box. Thus, in the prior art, when an oil radiator 16 was to be received inside a water box 10, it was necessary to use a water box, a perforated plate, and a gasket, which were unusual or special, thereby increasing the overall cost of the device.

Figure 2:
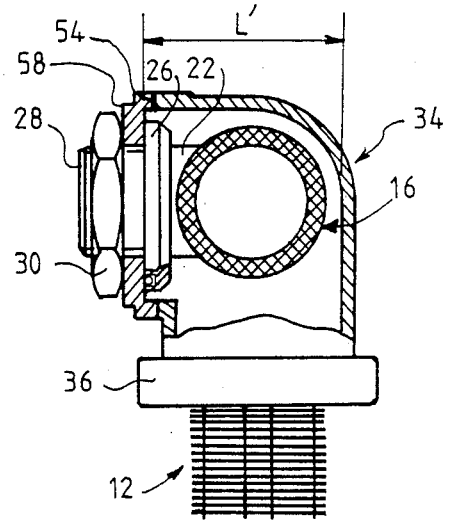
FIG. 2 is a diagrammatic view similar to FIG. 1, but showing a water box in accordance with the invention and containing the same oil radiator as that shown in FIG. 1.
Figure 4:
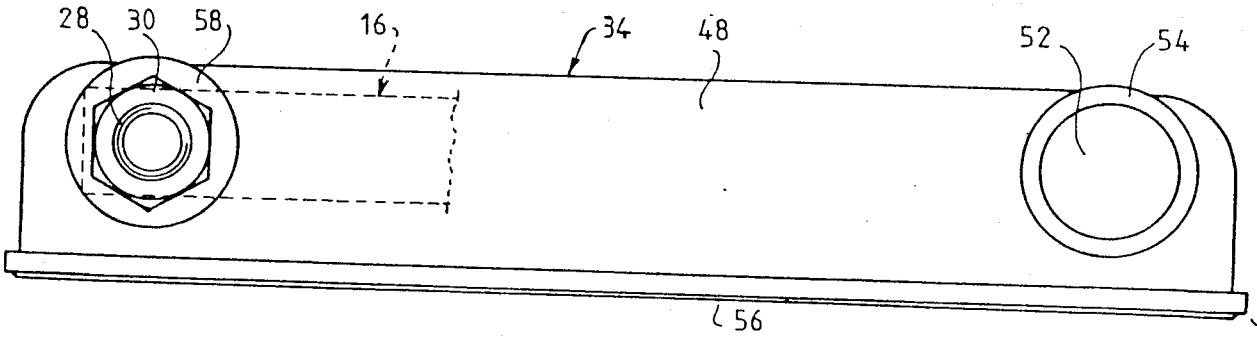
FIG. 4 is an elevation view of a water box in accordance with the invention.

Reference is now made to FIGS. 2 and 4 which show a water box in accordance with the invention.

This water box 34 is mounted on the end of a bundle of tubes 12 by means of a conventional perforated plate 36 which is identical to the perforated plate which would be used for fixing an ordinary water box thereto which did not contain an oil radiator 16. In other words the water box 34 in accordance with the invention has an inside width L′ equal to the inside width of a conventional water box corresponding to the size d of the bundle of tubes 12 and not containing an oil radiator.

The side wall 48 of the water box 34 having the oil inlet/outlet tubes passing therethrough has two circular openings 52, one of which can be seen on the right-hand side of FIG. 4. Each of the openings 52 is delimited by a plane annular peripheral rim 54 and is large enough to provide considerable clearance for an oil radiator inlet/outlet tube 22 while the oil radiator is being inserted into the water box 34 via its open face 56. Initially the tubes 22 point vertically upwardly, and subsequently they are tilted at a progressively greater angle towards the openings 52 as the radiator 16 moves further into the water box, ending up in the disposition shown in FIG. 2.

Each of the openings 52 through the water box is then closed by means of an add-on plate 58 which is circular in shape having an outside diameter substantially equal to the diameter of the peripheral rim 54 round the opening 52. Each circular plate 58 has an orifice through which the threaded end portion of an inlet/outlet tube 22 of the oil radiator passes.

Once the radiator 16 has been placed inside the water box 34 as described above, the plates 58 are threaded over the ends of the inlet/outlet tubes 22 together with corresponding sealing gaskets. The nuts 30 are screwed onto the ends of the tubes 22 and clamp the plates 58 against the annular flanges 26 on the tubes 22. Subsequently the plates 58 are fixed around their peripheries to the annular rims 54 of the openings 52 by ultrasonic welding, by gluing, or by any other suitable means.

The flanges 26 on the tubes 22 are of smaller diameter than the openings 52, thereby making it easy to dispose the oil radiator in a water box of normal width.

The fact that the oil radiator is generally cylindrical in shape also makes this disposition easier.

If necessary, the openings 52 through the wall of the water box could be non-circular in shape, and they could extend into the top wall of the water box.

Generally speaking, all that is required is that the largest transverse dimension of the oil radiator body should be smaller than the width of the open face of the water box in order to ensure that the radiator can be disposed without difficulty inside the water box.

What is claimed is:

1. In a water box for a motor vehicle heat exchanger, said box including an oil radiator therein having an oil inlet tube and an oil outlet tube which pass in sealed manner outwardly through two corresponding openings through the side wall of the water box between the inside and outside faces thereof, the improvement comprising said openings being considerably larger than the outside diameter of said oil inlet and outlet tubes for a tilting introduction of the inlet and outlet tubes outwardly therethrough, said tubes extending beyond the outside face of the side wall, and means for closing said openings and mounting said tubes, wherein the width of the water box is less than the overall width of the oil radiator and its oil inlet/outlet tubes in the same direction, said means comprising two add-on plates each of which includes an orifice for passing an oil inlet/outlet tube, and each of which is received over a different one of said tubes subsequent to introduction of said tubes through said openings, said add-on plates each being fixed to the outside face of the water box about the edge of the corresponding opening through the water box to define a continuation of the side wall of the water box and to mount the corresponding tube on the water box.

2. A water box according to claim 1, characterized in that each opening is of such a size as to leave considerable clearance to an oil inlet/outlet tube of the oil radiator when said radiator is inserted into the water box via the open face thereof which is subsequently placed over the end of the heat exchanger body.

3. A water box according to claim 1, wherein said openings and said add-on plates are circular in shape.

4. A water box according to claim 1, wherein each oil inlet/outlet tube includes an annular flange pressed against the inside face of the corresponding add-on plate, and wherein each oil inlet/outlet tube includes an end portion having an outside thread, said end portion extending beyond the opposite side of said plate and receiving a nut for clamping said plate against said annular flange.

5. A water box according to claim 4, wherein said annular flange has a maximum outside diameter which is smaller than the diameter of the opening.

6. A water box according to claim 1, wherein the oil radiator comprises two cylindrical walls connected to said two oil inlet/outlet tubes, and having a maximum transverse dimension in cross-section which is less than the width of the open face of the water box.

7. A water box according to claim 1, wherein each of said plates is fixed to the edge of the corresponding opening through the water box wall by welding or gluing.

* * * * *